United States Patent [19]

Long

[11] 4,451,949

[45] Jun. 5, 1984

[54] SAFETY SHOE AND METHOD FOR MAKING SAME

[75] Inventor: Thomas F. Long, Florissant, Mo.

[73] Assignee: Interco Incorporated, St. Louis, Mo.

[21] Appl. No.: 286,393

[22] Filed: Jul. 23, 1981

[51] Int. Cl.[3] ..... A43D 21/00

[52] U.S. Cl. ..... 12/146 C; 12/142 R

[58] Field of Search ..... 36/77 R, 77 M, 11, 107, 36/93, 55, 46.5, 47; 12/146 C

[56] References Cited

U.S. PATENT DOCUMENTS

| | | | |
|---|---|---|---|
| 511,141 | 12/1893 | Herzog | 36/55 |
| 1,523,133 | 1/1925 | McIntyre | 36/11 |
| 1,918,946 | 7/1933 | White | 36/11 |
| 2,287,026 | 6/1942 | Craig et al. | 36/55 |
| 2,438,016 | 3/1948 | McMurray | 36/77 R |
| 2,548,961 | 4/1951 | Foster | 36/11 |
| 2,694,870 | 11/1954 | Meltzer | 36/77 R |
| 3,350,795 | 11/1967 | Schlecht | 36/11 |
| 3,378,940 | 4/1968 | Potvin, Jr. | 36/11 |

FOREIGN PATENT DOCUMENTS

| | | | |
|---|---|---|---|
| 189230 | 9/1907 | Fed. Rep. of Germany | 36/46.5 |

*Primary Examiner*—Werner H. Schroeder
*Assistant Examiner*—Steven N. Meyers
*Attorney, Agent, or Firm*—Donald J. Fitzpatrick

[57] ABSTRACT

A safety shoe having a closed bottom lining is assembled by a method in which a slip last is inserted into a closed bottom lining and a net-fit upper portion is attached to the lining. The forepart of the upper portion is lasted to the lining after a steel toe sub-assembly is fastened to the lining toe portion. An outsole and heel portion are attached to the bottom surface of the upper after the upper and lining are lasted.

3 Claims, 8 Drawing Figures

SAFETY SHOE AND METHOD FOR MAKING SAME

BACKGROUND OF THE INVENTION

1. Field of the Invention

This invention relates to safety shoes and to a method for their assembly and more specifically to safety shoes that have a closed bottom, full lining with a steel toe sub-assembly disposed between the lining and shoe upper.

2. Description of the Prior Art

There is a wide variety of safety shoe styles available for different industries. Many industries have unique foot protection problems and safety shoes have been designed to meet these problems. Safety shoes are available that are: insulated, resistant to electrical hazards, puncture resistant, oil resistant and metatarsal guarded. These types are also available in different heights, finishes, constructions and materials. The shoe industry has, therefore, attempted to design safety shoes to meet and satisfy the specialized demands of industry by offering a variety of footwear having tailor-made characteristics.

Recently the shoe industry has been supplying dressy-styled safety footwear. These shoes are quite similar to conventional shoes in both appearance and selection of upper and lining materials. Boots, wing-tips, slip-ons and casual styles are now available for footwear protection in hazardous environments.

A particular style safety shoe has presented manufacturing problems and, thus, is not presently available. This is a shoe that employs a closed bottom lining laminated to a net-fit upper. A technique has not been available for inserting a steel toe assembly between the lining and upper prior to lasting. This problem is especially acute with moccasin type shoes.

SUMMARY OF THE INVENTION

The safety shoe of this invention comprises a closed bottom lining and a net-fit upper portion having a steel toe sub-assembly disposed between the lining and the upper. The steel toe sub-assembly is fastened to the lining before the forepart of the upper is lasted to the bottom surface of the lining.

It is, therefore, an object of this invention to provide a safety shoe that has a closed bottom lining and a net-fit upper with a steel toe sub-assembly disposed between the lining and the upper.

It is another object of this invention to provide a moccasin type safety shoe having a full leather lining and a net-fit upper.

A still further object of this invention is to provide a method for producing a safety shoe having a closed bottom lining, a net-fit upper and a steel toe sub-assembly disposed between the lining and the upper.

These and other objects will become apparent from the description of the invention as hereinafter more fully described.

DESCRIPTION OF THE PREFERRED EMBODIMENT

Figure 1:
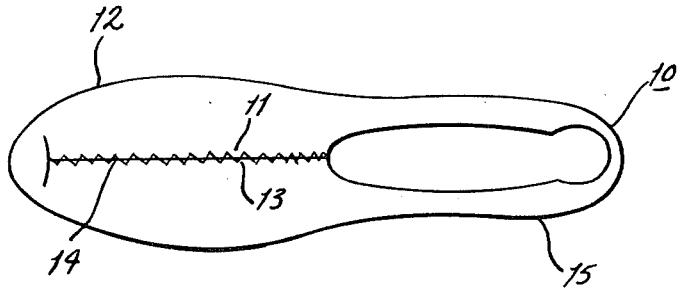
FIG. 1 is a bottom view showing the underside of a full lining which is stitched closed at the forepart.
Figure 2:
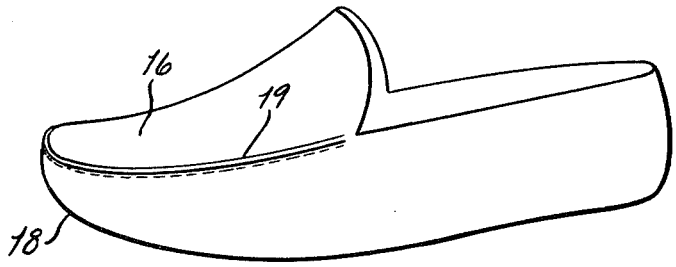
FIG. 2 is a perspective view showing a full lining.

FIG. 1 shows a lining 10 which may be a synthetic material, such as a vinyl, or a natural material, such as leather. A significant feature of the shoe construction of this invention is the utilization of a full leather lining, as will hereinafter be more fully described. As shown in FIG. 1, forepart 12 of the lining is closed by a longitudinal stitched seam 14. Thus, as seen in this FIG. 1, the lining has a closed bottom. FIG. 2 shows one embodiment of this invention, namely a moccasin type construction. As this figure illustrates, lining plug portion 16 is stitched to the lining vamp 18 along seam 19. This seam can be either hand-sewn or machine-sewn. It has been found to be particularly advantageous to sew this seam on a Goodyear machine as is well known in the art.

Figure 3:
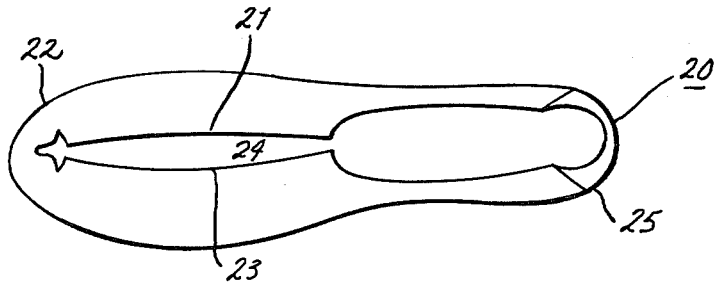
FIG. 3 is a bottom view of a net-fit shoe upper portion showing an open forepart.
Figure 4:
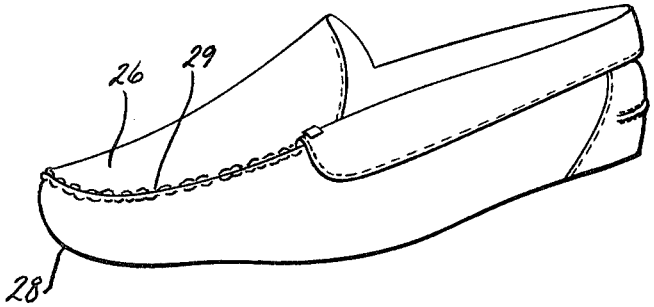
FIG. 4 is a perspective view of a shoe upper portion.

FIGS. 3 and 4 show a shoe upper 20 which may be of leather or other suitable upper material, as desired. As shown in FIG. 3, the upper is open at forepart 22 and is provided with a longitudinal opening 24. FIG. 4 shows plug 26 stitched to vamp 28 at 29 in a manner that corresponds to the lining as described in FIGS. 1 and 2. The upper can be hand- or machine-sewn, as is well known in the art. For cost effectiveness, it is particularly desirable to assemble the plug and vamp portions by machine sewing techniques.

A significant feature of the shoe construction of this invention is that lining 10 and upper 20 are net-fit components. A net-fit component is one that precisely and accurately fits a shoe last with substantially little trim or waste loss. In addition, there is no distortion of the component after the last has been inserted. The net-fit component assumes the last profile in a smooth, distortion-free manner. The significance of this net-fit characteristic can be illustrated in FIG. 1. When side portions 11 and 13 of the lining bottom are mated together and stitched along seam 14, there is an exact fit with no trim, waste or distortion of the lining. As will be hereinafter more fully described, when a last 30 is inserted into this lining, the lining assumes the last profile in a snug, smooth and distortion-free manner.

Figure 5:
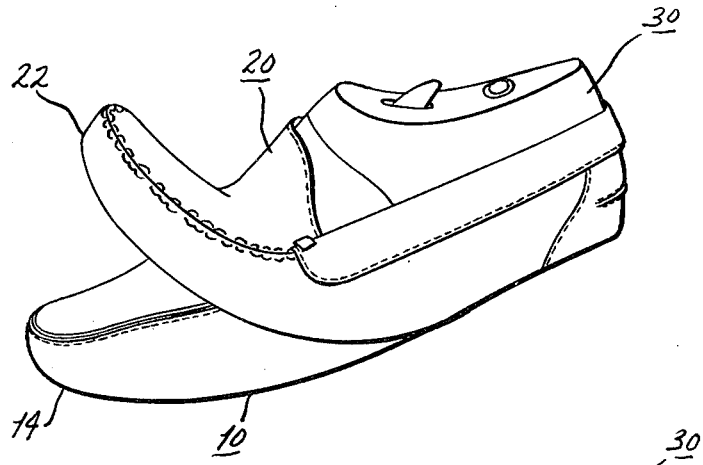
FIG. 5 is a perspective view of an assembly showing a slip last inserted into the lining and the upper portion being cemented and fastened to the back part of the lining.

FIG. 5 shows an assembly consisting of lining 10, upper 20 and last 30 inserted into the lining. In order to facilitate assembling the components of the shoe of this invention, it has been found that a slip-last must be employed. This is a last, hinged in the middle, that enables insertion and removal into the net-fit shoe components used in this invention. It has also proven advantageous, when uppers of leather are used, that such uppers must be moistened in order to provide proper fit of the shoe components. After last 30 is inserted into a lining, the back part of the upper is fastened to the lining by stitching and cementing. This assembly is complete after this fastening step and is now ready for the next processing step.

Figure 6:
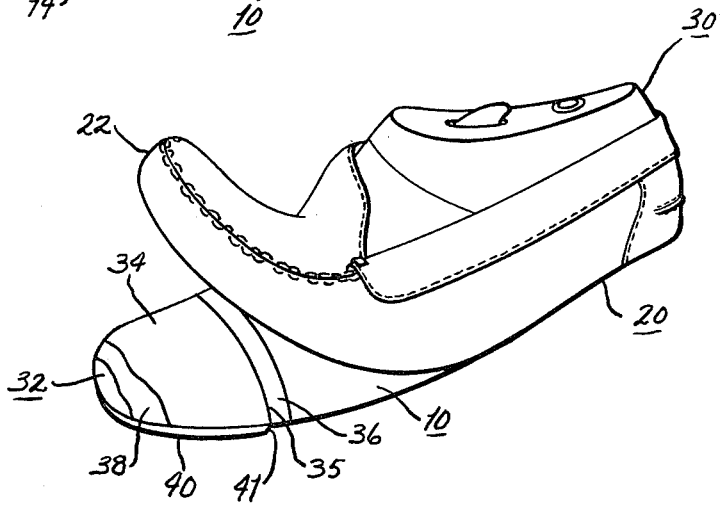
FIG. 6 is a perspective view of the assembly shown in FIG. 5 showing a steel toe sub-assembly fastened to the toe portion of the lining.

The assembly of FIG. 5 now receives a steel toe sub-assembly 32. This is accomplished by raising the upper forepart 22 up and over the lining forepart 12. As shown in FIG. 6, this sub-assembly consists of a steel toe cap 34 that is placed on the toe portion of lining vamp 18, a felt strip 36 is placed in an abuttting manner and adjacent to edge 35 of the steel cap. A layer of cushioning material 38, such as felt, is placed over the steel cap. Completing this sub-assembly is a fibre board toe piece 40 leveled at back edge 41 that is fastened to the bottom of the lining. Felt strip 36, cushioning material 38 and the fibre board 40 serve to mask the steel toe cap within the contour of the finished shoe. Thus, a more dressy look is achieved and the bulky appearance normally associated with steel toe caps of protective safety shoes is eliminated. Aside from these asethetic features, these materials have two very practical advantages. When the shoes are worn, the materials, in conjunction with the lining, shield the steel toe cap from direct contact with the wearer. In addition, these materials permit the shoes to absorb and dissipate the force of heavy falling objects. The padding distributes the force and tends to cushion it. Thus, these materials add to the comfort and safety of the shoe in use as well as improving the shoe appearance.

Figure 7:
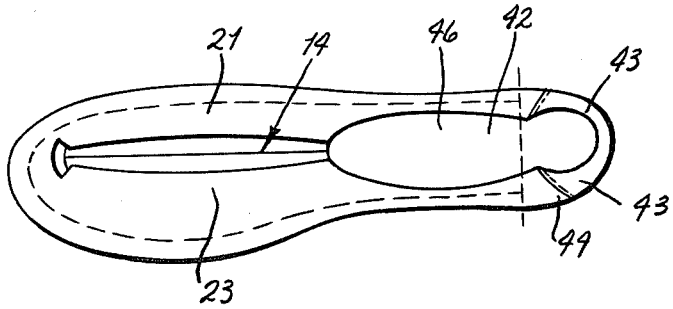
FIG. 7 is a bottom view of the shoe assembly after the forepart is pulled over the toe portion of the lining and prior to closing the upper portion.

After the steel cap sub-assembly is positioned, upper forepart 22 is pulled over the lining forepart. A fibre heel pin 42 is then inserted underneath the upper back part 44. A heel pad 46 is placed over the heel pin and extends toward the forepart region of the shoe. As shown in FIG. 7, the lining and the upper are now lasted to each other on the underside of the shoe. The shoe now assumes the profile of the last bottom. The forepart of the upper is lasted to the lining. This causes segments 21 and 23, that define the longitudinal opening 24, to meet and, therefore, form a closed bottom upper in the finished shoe. When shoes of this invention are worn, another comfort feature is achieved. The upper will not be felt by the wearer through the lining since both edges 21 and 23 of the upper are joined together and are adjacent to the lining seam 14. After the forepart is lasted, upper back part 44 is machine-nailed at 43 to the heel pin 42. The sides of the upper are now lasted to the lining, whereupon the upper and lining portions are completely lasted to each other.

Figure 8:
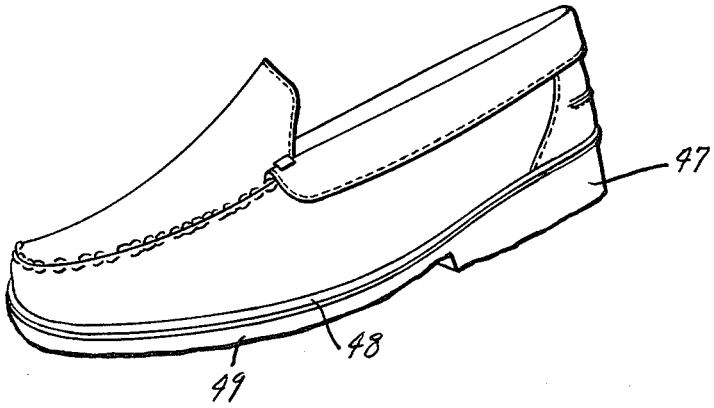
FIG. 8 is a perspective view of a finished shoe showing a heel portion and cemented and stitched outsole and midsole portions.

FIG. 8 shows a heel 47 attached to the upper back part 44. A midsole 48 is cemented to the bottom of the upper and an outsole 49 is stitched to the midsole. The outsole is of cellular resilient material containing many tiny air cells.

This invention may be practiced according to the following, but not limited, embodiment.

The stock for a net-fit leather lining 10 is cut. The forepart bottom is closed by sewing a longitudinal seam 14. A slip last 30 is inserted into the lining. A net-fit leather upper 20 having an open bottom is cemented to the back part of the lining. The upper forepart is maintained in a position above the lining forepart. The leather components of this shoe are moistened prior to assembly. This facilitates assembly of these net-fit components. The plug and vamp portions of the lining and upper are joined together with a sewn seam that resembles a moccasin type appearance. Thus, the assembled shoe of this embodiment will be a moccasin-type safety shoe. A steel toe cap 34 is cemented to the lining vamp 18. Padding and cushioning pieces are then added adjacent to the steel cap. The forepart of the upper is now hand-pulled over the lining forepart, enclosing and concealing the steel toe cap. A fibre heel pin 42 is inserted underneath the upper back part. A heel pad that extends throughout the rear part open region is added. The upper and lining are now lasted. This lasting closes the open forepart region, thus producing a closed bottom assembly. The rear portion is lasted and machine-nailed. A midsole, outsole and heel portion are added, thereby completing the assembly. The shoe is heat set so as to drive off moisture and finally the slip last is removed.

Various modifications of the invention, in addition to those shown and described herein, will become apparent to those skilled in the art from the foregoing description. Such modifications are intended to fall within the scope of the appended claims.

I claim:

1. In the method for making safety shoes, comprising the steps of:
   (a) providing a net-fit, closed bottom lining;
   (b) inserting a slip last into said lining;
   (c) placing a net-fit, upper portion having a forepart region and a back part region onto the last and in contact with said upper, while leaving said upper forepart region raised over said lining forepart region;
   (d) attaching said upper back part region to said lining back part region;
   (e) placing a steel toe sub-assembly onto said lining forepart; and
   (f) pulling said upper forepart region over said lining forepart thereby enclosing said steel toe sub-assembly between said upper and said lining.

2. The method of claim 1 further comprising the steps of:
   (g) lasting said forepart region of said upper portion to said lining so as to close said upper forepart bottom.

3. The method of claim 1 further comprising the steps of:
   (h) attaching an outsole and heel portion to said upper bottom region; and
   (i) removing said slip-last.

* * * * *